US006209282B1

(12) United States Patent
Lafrance

(10) Patent No.: US 6,209,282 B1
(45) Date of Patent: Apr. 3, 2001

(54) FRAMING STUDS FOR THE CONSTRUCTION OF BUILDING STRUCTURES

(76) Inventor: Claudex Lafrance, 196, 48 ìàeme rue ouest, Charlesbourg Quebec (CA), G1H 5G1

( * ) Notice: Subject to any disclaimer, the term of this patent is extended or adjusted under 35 U.S.C. 154(b) by 0 days.

(21) Appl. No.: 09/215,739

(22) Filed: Dec. 17, 1998

(51) Int. Cl.[7] ..... E04C 3/14

(52) U.S. Cl. ..... 52/729.1; 52/729.2; 52/729.4; 52/481.1; 52/690; 52/696

(58) Field of Search ..... 52/729.1, 729.2, 52/729.4, 736.2, 481.1, 690, 696

(56) References Cited

U.S. PATENT DOCUMENTS

| | | | | |
|---|---|---|---|---|
| 1,911,413 | * | 5/1933 | Wait | 52/481.1 |
| 2,103,064 | * | 12/1937 | Clark | 20/95 |
| 2,332,052 | * | 10/1943 | Brent | 52/481.1 |
| 2,716,261 | * | 8/1955 | Huffman | 52/690 |
| 3,490,188 | * | 1/1970 | Troutner | 52/644 |
| 3,999,343 | * | 12/1976 | Roberts | 52/241 |
| 4,228,631 | * | 10/1980 | Geffe | 52/690 |
| 4,815,243 | * | 3/1989 | Pardo | 52/100 |
| 4,852,322 | * | 8/1989 | McDermid | 52/404 |
| 5,295,334 | * | 3/1994 | Haraden | 52/1 |
| 5,526,625 | * | 6/1996 | Emblin et al. | 52/437 |
| 5,713,176 | * | 2/1998 | Hunt | 52/731.5 |
| 5,867,962 | * | 2/1999 | Scott et al. | 52/696 |
| 5,953,883 | * | 9/1999 | Ojala | 52/794.1 |
| 5,964,071 | * | 10/1999 | Sato | 52/656.1 |
| 5,996,303 | * | 12/1999 | Pellock | 52/693 |

* cited by examiner

*Primary Examiner*—Carl D. Friedman
*Assistant Examiner*—Phi Dieu Tran A
(74) *Attorney, Agent, or Firm*—Swabey Ogilvy Renault; Guy J. Houle

(57) ABSTRACT

A composite wood joist for the construction of building structures is comprised of an elongated straight main member and a transverse elongated web piece connected thereto. Both the main member and the web piece are of rectangular cross-section with the web piece being secured along a narrow flat end face of the main member. The web piece is dimensioned and disposed to extend beyond the opposed flat side faces of the main member to define opposed wing sections. The web piece also has a width which is narrower than the width of the main member and it provides an arresting force against longitudinal distortion of the straight elongated main member and improves the load bearing capacity thereof.

21 Claims, 8 Drawing Sheets

FRAMING STUDS FOR THE CONSTRUCTION OF BUILDING STRUCTURES

TECHNICAL FIELD

The present invention relates to a composite wood stud structure for the construction of building structures and particularly, but not exclusively, for use in the construction of walls and interconnectable with bottom and top plate members.

BACKGROUND ART

Composite joist structures are known and examples thereof can be found in U.S. Pat. No. 2,166,096 which describes an H-shaped metal beam to which is secured adjacent one elongated web thereof a longitudinal wooden stud. Composite studs have also been constructed from a thin web sheet having opposed wood strips extending substantially parallel to each other and at opposed ends and sides of the web. Such a construction is described in U.S. Pat. No. 5,144,785. Other types of H-like studs are disclosed in U.S. Pat. No. 4,658,557. There is also known a multitude of metal formed studs which engage in lower and top horizontal channels at predetermined locations therealong. Examples of these can be found in U.S. Pat. Nos. 3,101,817, 5,274,973 and 5,394,665.

SUMMARY OF INVENTION

It is a feature of the present invention to provide a composite stud which is economical to produce, which has excellent load bearing capacity and which is incorporated into a construction system to facilitate the erection of building structures and result in considerable savings of time and money.

According to the above feature, from a broad aspect, the present invention provides a composite wood stud for the construction of building structures. The stud is comprised of an elongated straight main member of substantially rectangular cross-section and having opposed flat side faces and opposed narrow flat end faces. A transverse elongated web piece of rectangular cross-section is secured along one of the opposed narrow flat end faces. The web piece is dimensioned and disposed to extend beyond the opposed flat side faces to define opposed wing sections. The web piece also has a width which is narrower than the width of the main member. The web piece provides an arresting force against longitudinal distortion of the straight main member and improves the load bearing capacity thereof.

According to a further broad aspect of the present invention there is provided a composite wood stud as above described in the previous paragraph and wherein the main member and the web piece(s) form a T-shaped cross-section load bearing wood stud.

According to a further broad aspect of the present invention the web piece is dimensioned and disposed to extend from one of the opposed flat side faces of the main member and beyond the other opposed flat side faces thereof to constitute a wing and thus a wood stud of substantially L-shaped cross-section.

BRIEF DESCRIPTION OF DRAWINGS

A preferred embodiment of the present invention will now be described with reference to the accompanying drawings in which.

DESCRIPTION OF PREFERRED EMBODIMENTS

Figure 2A:
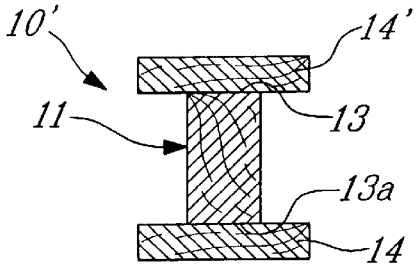
FIGS. 2A and 2B are cross-section views of the composite wood stud of FIGS. 1A and 1B showing a further variant thereof wherein two web pieces are secured along narrow flat end faces of the main member.
Figure 2B:
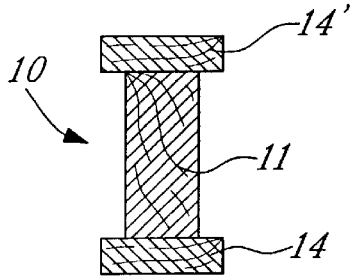
Figure 3A:
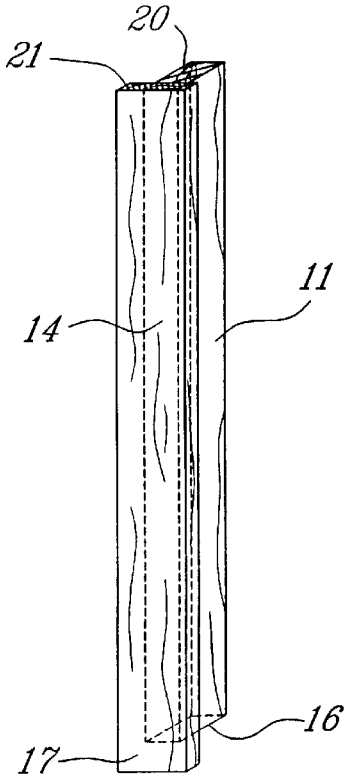
FIGS. 3A and 3B are perspective views of the composite wood stud shown in cross-section in FIGS. 1A and 2A respectively and illustrating the bottom and top projecting tongues formed by the web pieces.
Figure 3B:
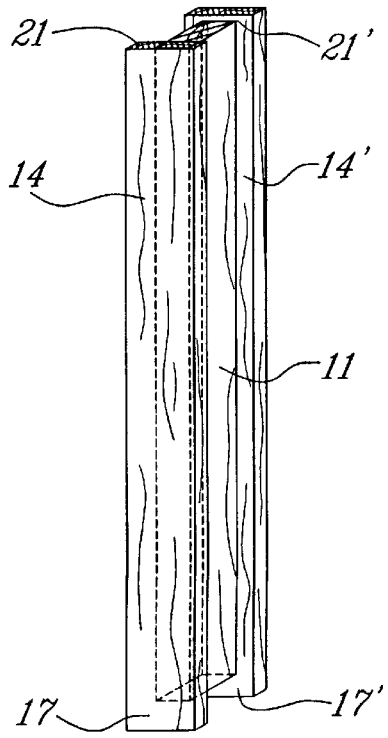
Figure 4A:
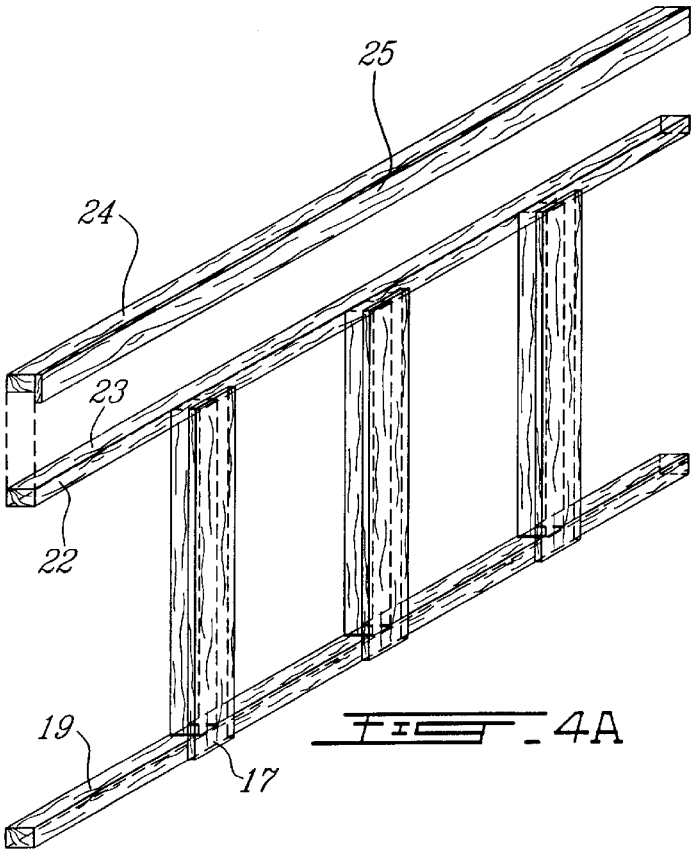
FIG. 4A is a perspective view, partly exploded, illustrating the construction of a wall frame with the composite wood stud of the present invention and its connection to the bottom and top plates.
Figure 4B:
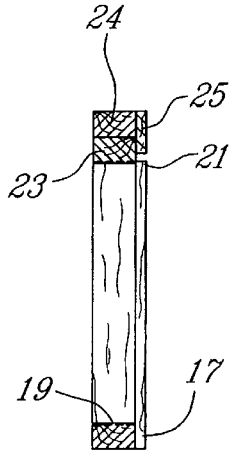
FIG. 4B is a section view showing the construction of a wall, as in FIG. 4A, and illustrating the construction of the top and bottom plates and the projection of the top and bottom tongue of the web and utilizing the composite wood stud of FIG. 1A.
Figure 10:
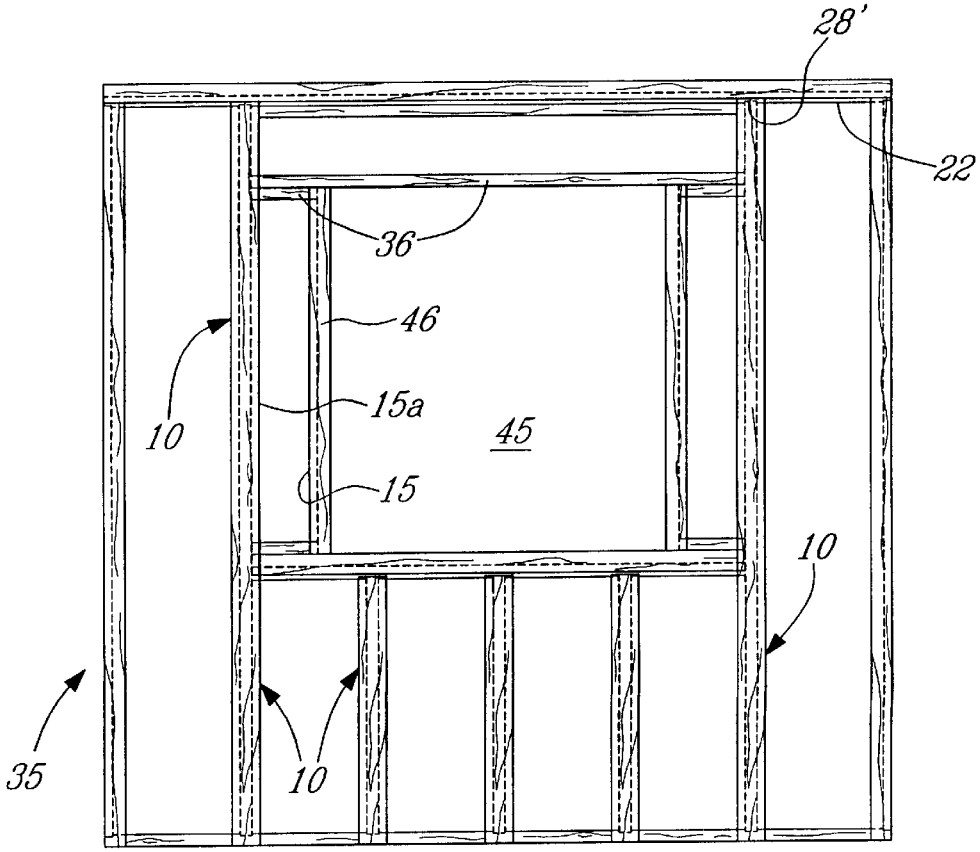
FIG. 10 is a plan view showing a wall framed with the composite wood stud of the present invention.

Referring now to the drawings, and more particularly to FIGS. 1A to 3B, there is shown generally at 10 the composite wood stud of the present invention for the construction of building structures, such as the walls as shown in FIGS. 4A and 10. The composite wood stud 10 consists of an elongated straight main member 11 of substantially rectangular cross-section and having opposed flat side faces 12 and 12A and opposed narrow flat end faces 13 and 13A. A transverse elongated web piece 14, of rectangular cross-section, is secured along one of the opposed narrow flat end faces 13 or 13A.

Figure 1A:
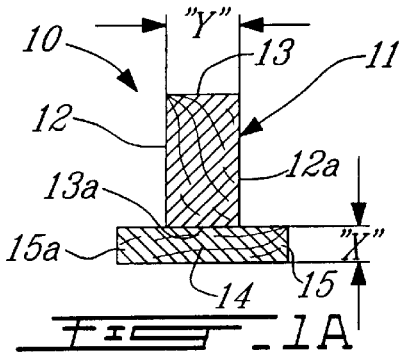
FIGS. 1A and 1B are cross-section views of a composite wood stud of the present invention showing variations of the size of the elements of the composition.
Figure 1B:
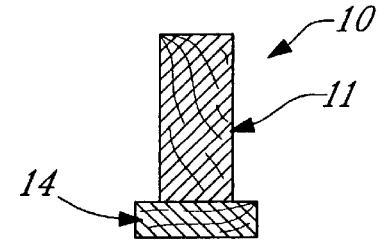

The web piece 14 is dimensioned and disposed to extend beyond the opposed flat side faces 13 or 13A to define opposed wing sections 15 and 15A. The web piece 14 has a width "X" which is narrower than the width "Y" of the main member. As shown in FIG. 1B, the web piece 14 may be of shorter length and the main member 10 has a greater cross section. For example, in FIG. 1A, the main member could be a 2×3 inch stud whereas in FIG. 1B it is a 2×4 inch stud. The stud main members may also be 2×6 inch studs. The web piece 14 is nailed on or otherwise fastened to the main member to provide a solid connection therewith whereby to provide an arresting force against longitudinal distortion of the straight main member 11, particularly if the wood contains humidity, and to improve the load bearing capacity thereof.

As shown in FIGS. 2A and 2B, the composite wood stud 10' as therein shown is H-shaped and comprised of a web piece 14' secured to the other flat end face 13 of the main member 11 and this provides greater resistance to longitudinal distortion and further improves low bearing capacity. As shown in FIG. 2B, the configuration of the elements forming the composite wood stud have different dimensions. A multitude of other variants in cross-sectional dimensions is achievable, as is obvious.

Figure 5A:
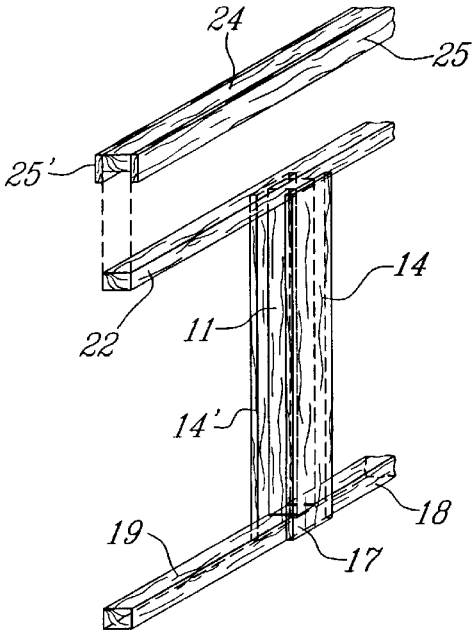
FIGS. 5A and 5B are similar to FIGS. 4A and 4B but illustrating a wall constructed with the composite wood stud of FIG. 2A.

With reference now to FIGS. 3A and 3B, it can be seen that the web piece 14 extends beyond a lower end 16 of the main member 11 to define a bottom projecting tongue 17 which is adapted to extend over a side face 18, see FIG. 5A, of a wall bottom plate 19. If opposed web pieces 14 and 14' are secured to the main member or stud 11, then a projecting tongue 17' would also be provided on the opposed side of the main member 11.

The web piece 14 also extends beyond a top end 20 of the main member 11 to define a top projecting tongue 21 and 21'. This projecting tongue is better seen with further reference to FIGS. 4A to 5B. As can be seen in these additional Figures the top projecting tongue 21 extends onto a side face 22 of a top plate member 23 of a wall. Accordingly, the web pieces complete the connection between the bottom plate 19 and top plate 23 by nailing or otherwise fastening these tongues to the bottom and top plate members to retain the main member 11 captive therebetween.

Figure 5B:
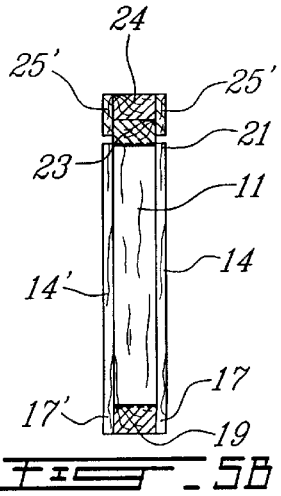

As shown in FIGS. 5A and 5B, the composite stud is of the type as shown in FIG. 3B and the main member 11 is captive between the web pieces 14 and 14' and the top and bottom plates 23 and 19. The top plate 23 is also provided with two construction pieces, therein 2×4's or 2×3's, namely elements 23 and 24 with a face board 25 connected to the top element 24 and bridging the top plate 23 whereby to interlock them together through the face. The face board is of the same thickness as the web piece so as to provide a flat plane surface to attach construction sheeting material thereto such as gypsum wall boards. As shown in FIG. 5B, there are two face boards 25 and 25' or horizontal web pieces secured respectively to opposed sides of the upper elongated horizontal element 24 when using a composite stud as shown in FIG. 3B. A wall structure as shown in FIG. 5B could be an interior division wall or an exterior wall.

Figure 6:
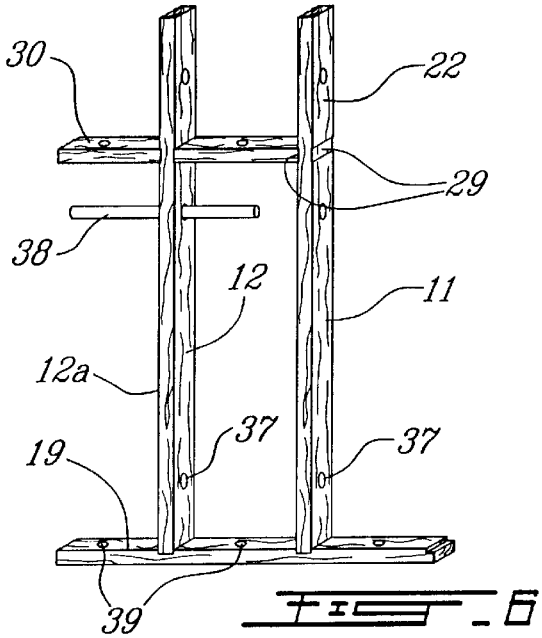
FIG. 6 is a perspective view illustrating modifications made to the bottom plate and the main member of the composite wood stud whereby to interconnect therewith and therebetween cat members and to accommodate for the passage of electrical wiring or piping.
Figure 7:
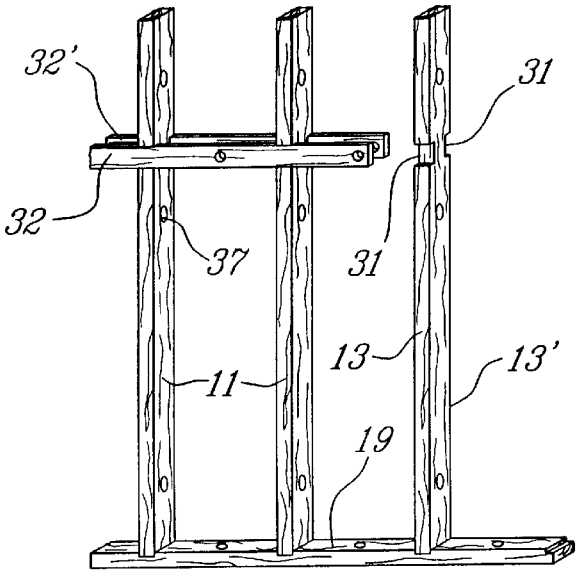
FIG. 7 is a further perspective view illustrating a further modification to the main member of the composite wood stud whereby to interconnect with a horizontal wood bracing board.
Figure 8:
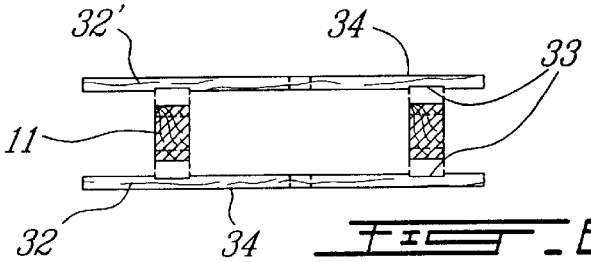
FIG. 8 is a fragmented section view showing the framing boards being notched to interlock with the horizontal notches or grooves provided in the main members of the composite wood stud.
Figure 9:
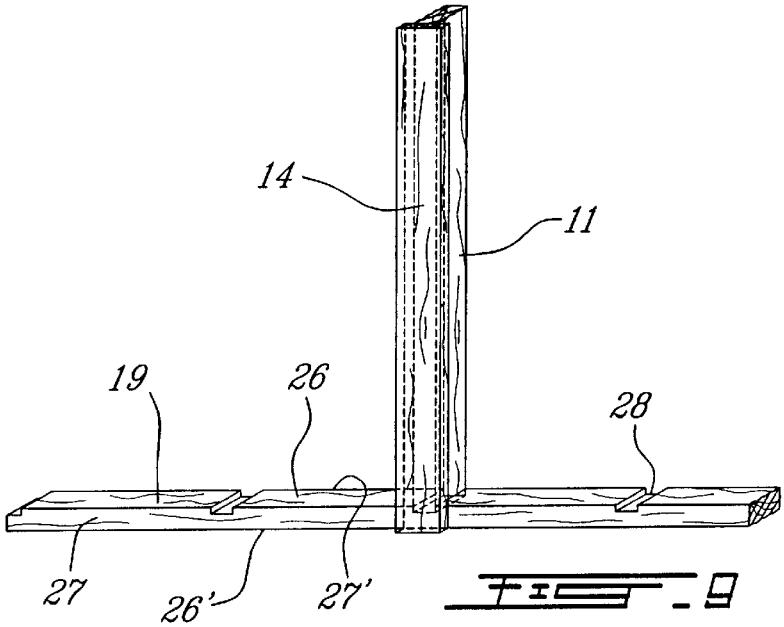
FIG. 9 is a fragmented section view showing how a composite wood stud is located at a predetermined location within the transverse slot formed in a bottom plate and how the web tongue overlaps with the front edge of the bottom plates.

Referring now to FIGS. 6 to 8, there will be described various other features of the composite wood stud structure as well as the bottom and top plates. As shown in these Figures, the bottom plate 19 is an elongated wood piece of rectangular cross-section defining opposed flat side faces 26 and 26' and opposed narrow flat end faces 27 and 27'. A plurality of equidistantly spaced transverse grooves 28 of rectangular cross-section, are formed in the upper side face 26 and dimensioned to receive a lower end portion of the main member 11, as illustrated in FIGS. 6, 7 and 9. The main member is received in close fit within the grooves 28. Accordingly, these grooves as well as providing a better connection with the bottom plate 9, also automatically space the composite studs at predetermined intervals such as 12 inch, 16 inch, or 24 inch, etc., spacing.

As also shown in FIG. 10, the top plate 22 may also be provided with transverse rectangular grooves 28' to receive the other end of the main member 11 therein.

As shown in FIG. 6, the main member 11 may also be provided with a transverse rectangular groove 29 and 29' on opposed flat side faces 12 and 12A thereof and disposed in alignment therewith at a predetermined location from the bottom plate 19. These grooves 29 receive therebetween a cat member 30 which provides bracing between the studs and also provide a backing element to which surface sheeting can be secured. Usually, these cat members are located at a spacing of 4 feet from the floor surface or the bottom edge of the bottom plate 19 to provide edge nailing of 4×8 feet sheeting material.

Referring to FIG. 7, it can be seen that the main members 11 may also be provided with transverse rectangular grooves 31 on one or opposed ones of its flat end faces 13 and 13' and again disposed at a predetermined distance from the bottom edge of the bottom plate 19 for the purpose as above-described. An elongated wood brace board or wood strip 32 is received in these aligned grooves 31 of adjacent studs 11 whereby to maintain the studs in perfect parallel relationship. To do this in a more expeditious manner, the wood strips 32 and 32', if they are provided on each side of the studs, may also be notched with a rectangular groove 33 as illustrated in FIG. 8. This interlocks the wood strip 32 with the studs 11 and the outer faces 34 of these strips are then aligned flush with the outer end faces 13 and 13' of the studs so that the web pieces 14 can then be connected thereto. However, in such an application the composite wood studs are constructed on site as the wall is erected. With the embodiment shown in FIG. 6, the composite wood pieces 10 could be premanufactured as the cat element 30 may be positioned thereafter.

Referring again to FIG. 10, there is shown the construction of a wall 35 constructed using the composite wood stud 10 of the present invention. It can be seen for example that cross pieces such as cross pieces 36 are held captive between the wing sections 15 and 15A providing for better bracing and providing additional nailing surfaces.

Figure 11:
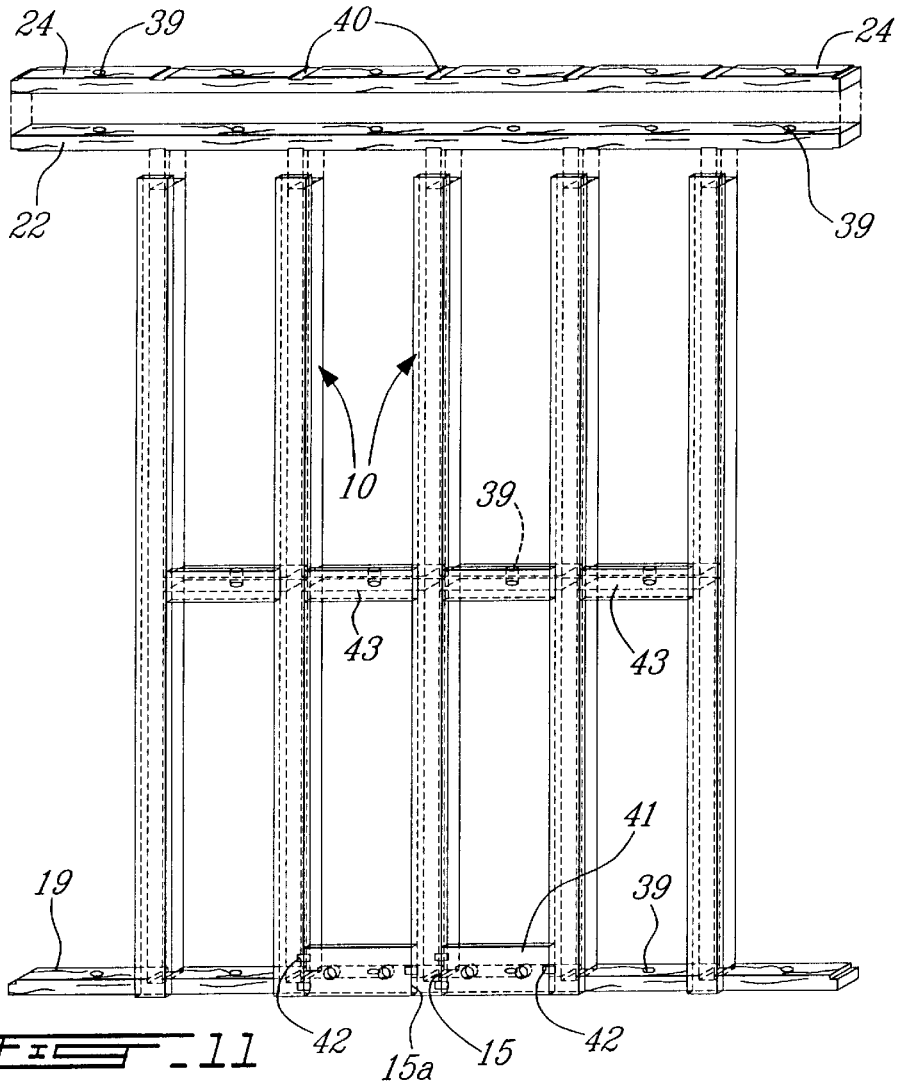
FIG. 11 is a perspective view, partly exploded, showing variations in the construction of a wall frame using the composite wood studs of the present invention and their associated bottom and top plate assemblies.

With reference again to FIGS. 6 and 7, it can be seen that the main members 11 may also be provided with through bores 37 extending across the opposed flat side faces 12 and 12' of the main member to receive therethrough wiring or piping as illustrated at 38. Through bores 39 may also be provided in the bottom plate 19 as well as in the cat members 30 and the top plate members 22 and 24, as shown in FIG. 11. As also shown in FIG. 11 the top horizontal top plate member 24 may also be provided with transverse notches 40 spaced at predetermined intervals whereby to receive therein rafters to construct an upper floor or trusses of a roof structure if a roof is to be constructed thereover. Rectangular plates 41 may also be interconnected between the wings 15 and 15A of adjacent composite wood studs 10 by clips 42 or other means to provide a quick connection. It is to be noted that with the use of the composite wood studs of the present invention and the associated bottom and top plates 19 and 22, the construction of walls is "substantially perfect" and this accommodates these plates 41 to which electrical junction boxes may be secured without having to provide additional cat members. Composite cats 43 may also be connected at an appropriate height to provide additional wider nailing surfaces or the connection of electrical boxes or other types of elements thereto.

Figure 12:
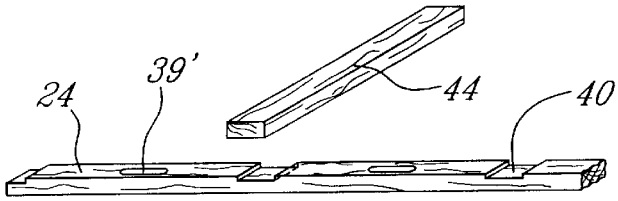
FIGS. 12 and 13 are fragmented perspective views showing the transverse connection of further construction members with the top or bottom plates.
Figure 13:
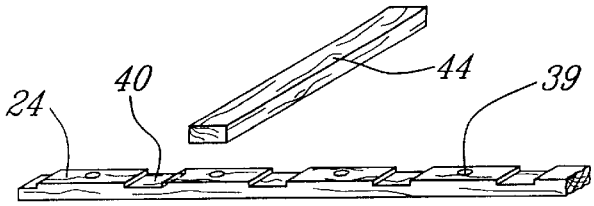

As can be seen from FIGS. 12 and 13, the upper member 24 of the top plate may be notched to receive horizontally opposed transverse members 44 which may be notched or not to construct ceilings. Also the configuration of the through bores 39 may be slotted as shown at 39' in FIG. 12. Again, as previously described these grooves 40 may be equidistantly spaced closer to one another, such as 12 inches apart as shown in FIG. 13, to provide closer spacing of elements 44 connected thereacross.

Figure 14:
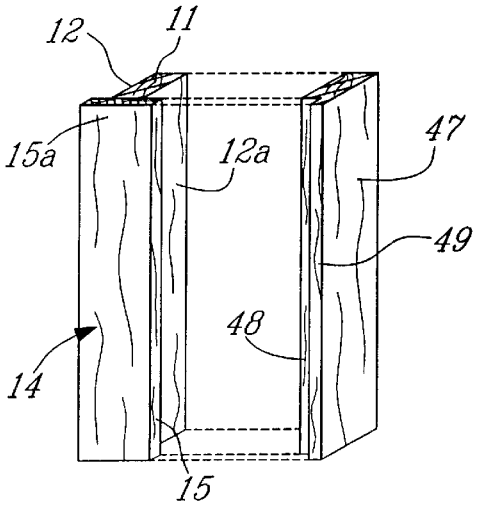
FIGS. 14 and 15 are fragmented perspective views showing a jamb receiving plate secured to the composite wood stud to provide a frame for a window or door opening and using T- or H-shaped composite wood stud.
Figure 15:
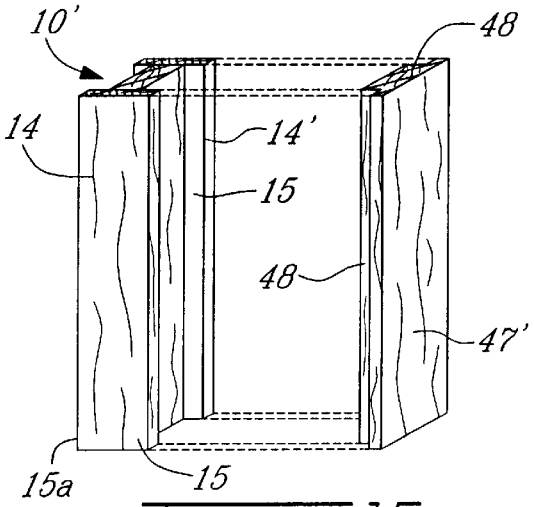

With reference now to FIGS. 14, 15 and 10, it can be seen from FIG. 10 that a window opening 45 is formed within the wall structure 35. In order to provide a flush side wall surface 46 to nail a window frame thereto, there is further provided, as shown in FIGS. 14 and 15, a jamb receiving member 47 which is secured to the opposed flat side face 12A of the main member 11 and it fits and overlaps the wing section 15 of the web piece 14. Accordingly, this jamb receiving member 47 is formed from a wood piece having a rectangular cross-section with an elongated rectangular notch 48 formed along an edge portion of one of the opposed narrow end faces, herein end face 49 of the member 47 and dimensioned to receive the wing section 15 of the web piece 14 in close fit therein. The jamb receiving member 47 is nailed directly into the main member 11. Accordingly, a side wall surface 46, as shown in FIG. 10, is obtained and the combination of the jamb receiving member 47, and the composite stud 10 provide good load bearing and resistance to distortion and this is extremely important about a window frame.

As shown in FIG. 15, the jamb receiving member 47' is provided with opposed elongated rectangular notches 48 and 48' when the composite wood stud 10' is provided with opposed web pieces 14 and 14" whereby to receive the wing sections 15 of each of the opposed web pieces.

Figure 16:
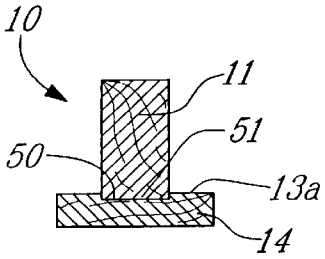
FIGS. 16 to 20 are cross-section views showing a further modification of the construction of the composite wood stud of the present invention and wherein the webs may be provided with a groove along their central longitudinal axis to mate with the end faces of the main member and wherein two main members may be connected to the web or to a pair of webs or three webs to form composite load bearing stud.
Figure 17:
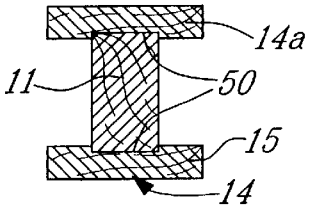

FIGS. 16 to 20 show various other modifications to the construction of a composite wood stud 10. As shown in FIG. 16, the web piece 14 is provided with a central longitudinal groove 50 of shallow rectangular cross-section whereby to receive therein an outer end section 51 of the narrow flat end face 13A of the main member 11. FIG. 17 shows structures similar to FIG. 16 but wherein there are opposed web pieces 14 and 14A both provided with the central longitudinal groove 50. This groove further assists in the resistance against longitudinal distortion of the longitudinal main member 11.

Figure 18:
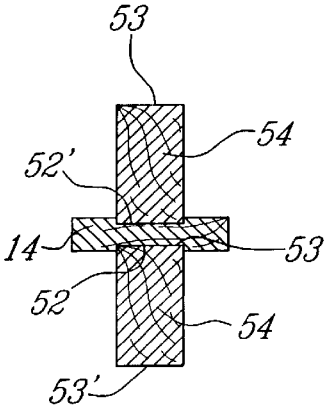
Figure 19:
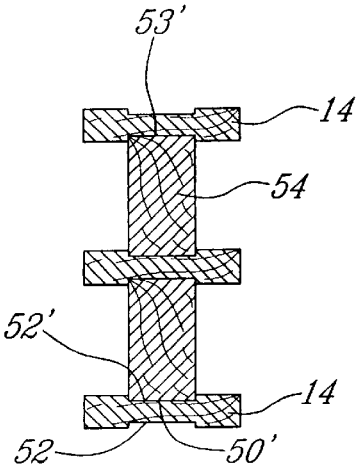
Figure 20:
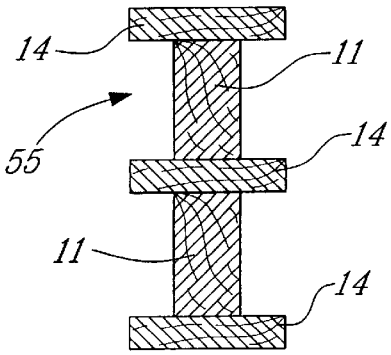

FIGS. 18 and 19 show a different type of structural member which is comprised of a web piece which is provided with opposed longitudinal grooves 52 and 52' each adapted to receive an end section of the flat end faces 53 of opposed studs 54 interconnected together through the web piece 14. As shown in FIG. 19, end web pieces 14 may be connected over the other end faces 53' of the studs 54. Alternatively, a composite load bearing stud assembly may be interconnected together as shown in FIG. 20 to form a double H load bearing composite stud assembly generally illustrated by reference numeral 55.

Figure 21A:
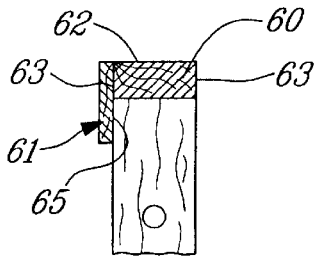
FIGS. 21A to 21C show the modification of the composite wood stud and wherein the web piece extends from one of the opposed flat side faces of the main member and extends beyond the other side face and wherein the wood stud is utilized in the construction of wall endings where the wing connects with further wall constructing elements to enhance the load bearing capacity thereof.

Referring now to FIGS. 21A to 24B, there will be described a composite wood stud similar to that as described and illustrated in FIGS. 1A and 1B but wherein the wood stud is comprised of a main member 60, as shown in FIG. 21A, having a web piece 61 dimensioned and disposed to extend from one of the opposed flat faces only, herein face 62 of the main member 60 and disposed on its end face 63 and extending beyond the other end face 62' to constitute a single wing 65. As shown in FIGS. 21B and 21C, the wing 65 of the web piece 61 is connectable to further wall constructing elements, herein a further stud element 66. The wing has an extent which is at least equal or longer than the width of the end faces 63 of the main member 60. These composite L-cross-section wood studs are for use in the construction of ends of walls such as corners or intersecting wall sections where there is a need to provide for improved load bearing and backing members for securing wall covering boards thereto, as is well known in the art.

Figure 22A:
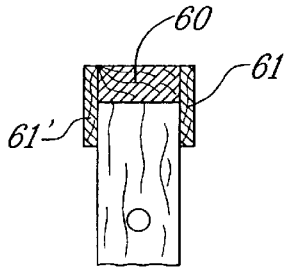
FIGS. 22A to 22C are section views similar to FIGS. 21A to 21C and wherein there are two web pieces associated with a respective one of opposed narrow end faces of the main member.
Figure 21B:
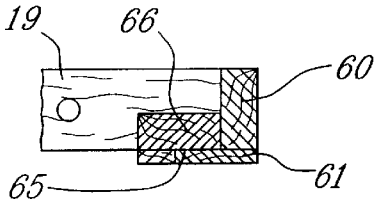
Figure 22B:
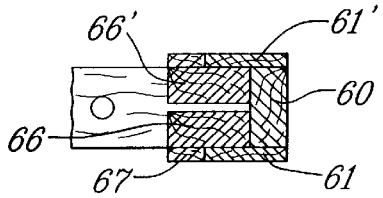
Figure 21C:
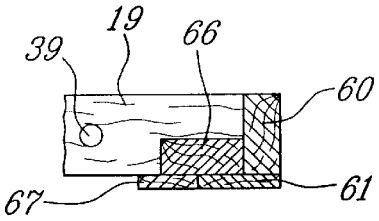
Figure 22C:
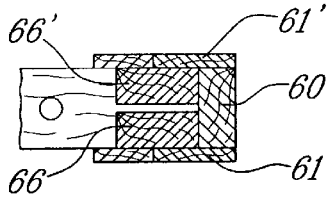
Figure 23A:
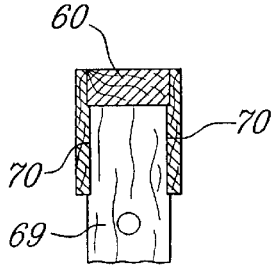
FIGS. 23A and 23B are cross section views similar to FIGS. 22A and 22B and wherein the web pieces are notched and have a longer extent in its wing section.
Figure 24A:
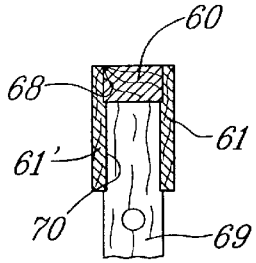
FIGS. 24A and 24B illustrate a further modification of FIGS. 23A and 23B.
Figure 23B:
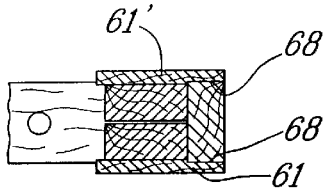
Figure 24B:
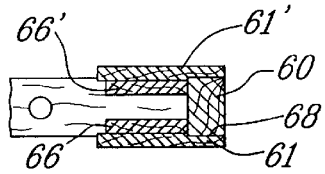

As shown in FIGS. 22A to 22C, the web pieces 61 and 61' may be provided on opposed sides of the main member 60 and they may receive a pair of studs 66 and 66' therebetween to provide a different wall end structure. Wood strips 67 are also secured to the studs 66 and 66' to provide a nailing surface.

FIGS. 23A, 23B, 24A and 24B show further variants wherein the web pieces 61 and 61' are notched at 68. With such structures that it is necessary to also notch the base or top plates 69, as shown by reference numeral 70.

Figure 25:
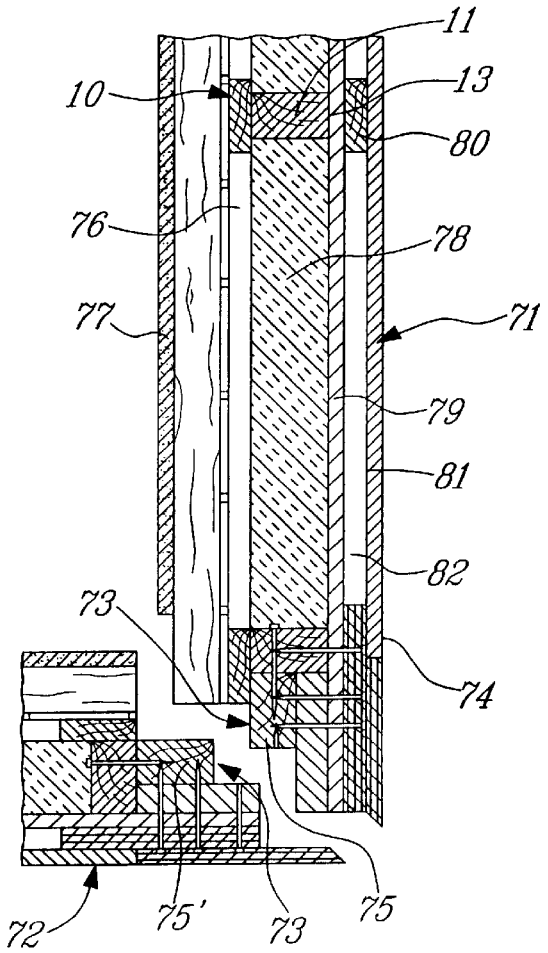
FIG. 25 is a section-view of a corner of prefabricated panels in which the corner structures are utilized and intermesh to secure adjacent panels together, herein two corner panels.

FIG. 25 shows a pair of prefabricated wall panels 71 and 72 having composite wood stud corner structures 73 and 73' which interfit and which may be easily connected together from the outside wall surface 74 by driving fasteners, herein long nails, therethrough whereby the mating surfaces of the wood pieces 75 and 75' interconnect with one another. As shown in the prefabricated wall, a T-shaped composite wood stud 10 is utilized in its construction and as hereinshown it also provides an air barrier 76 between the inner wall gypsum panel 77 and the insulation 78. A vapor barrier sheet 79 is secured to the end face 13 of the main member 11 and a spacer 80 is secured in line with the main member stud 11. An outer finishing board 81 is secured to the spacer 80 with a further air barrier space 82 therebetween. This is only a typical example of how the composite wall panel may be constructed and there are, of course, various other structures depending on the use of the panels. For example, these pre-fabricated panels could be used to construct refrigerated housings and this would involve a different combination of materials.

Figure 26:
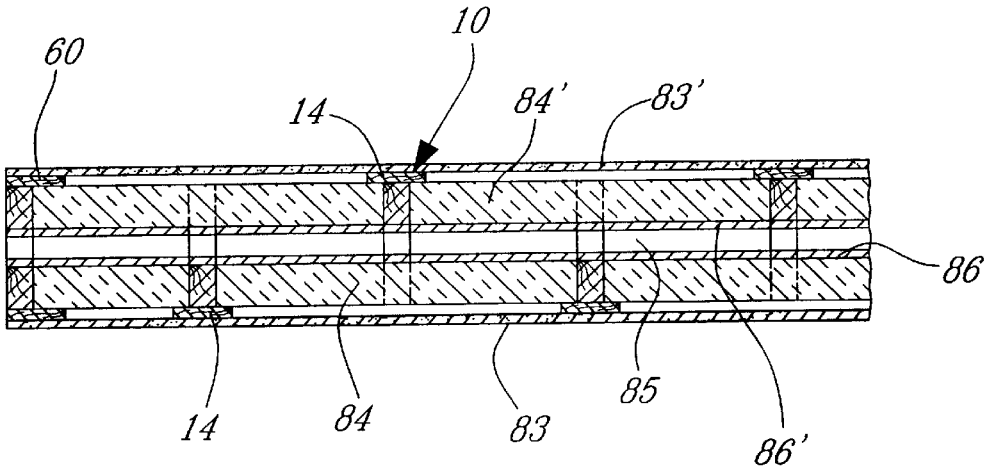
FIG. 26 is a further section view showing a construction of a sound-proof partition wall using composite wood studs of the type illustrated in FIGS 1*a* and 1B.

FIG. 26 shows a typical example of the construction of a sound-proof partition wall that we normally find between row housings. As hereinshown the partition or division wall is constructed with a composite wood stud 10 a shown in FIG. 1A and a composite wood stud 60 for the corner structures, as shown in FIG. 21A. The web pieces 14 provide a spacing on opposed sides of the wall to which is attached gypsum boards 83 and 83'. Insulation is provided on both sides as illustrated by reference numerals 84 and 84' and an air space 85 is provided inbetween. The space 85 could be filled with sound damping materials and the inner boards 86 and 86' may also be sound absorbing boards, as are known in the art.

It is within the ambit of the present invention to cover any obvious modifications of the preferred embodiment described herein, provided such modifications fall within the scope of the appended claims.

What is claimed is:

1. A composite wood stud for the construction of building structures, said stud being comprised by an elongated straight main member of substantially rectangular cross-section and having opposed flat side faces and opposed narrow flat end faces, and a transverse elongated web piece of rectangular cross-section secured along one of said opposed narrow flat end faces to improve load bearing of said stud, said web piece being dimensioned and disposed to extend beyond said opposed flat side faces to define opposed wing sections and having a width narrower than the width of said main member, each said wing sections extending beyond opposed flat side faces of said main member a common distance which is less than the transverse length of each said side faces, said web piece providing an arresting force against longitudinal distortion of said straight main member and improving the load bearing capacity thereof, said web piece also extending beyond a lower end and a top end of said main member to define a bottom and top projecting attachment tongue.

2. A composite wood stud as claimed in claim 1 wherein there are two of said elongated web pieces secured respectively to one of said opposed narrow flat end faces of said main member.

3. A composite wood stud as claimed in claim 2 in combination with a wall bottom plate and top plate, said bottom and top projecting attachment tongues extending over opposed side faces of said wall bottom plate and top plate to be secured thereto.

4. A composite wood joist as claimed in claim 3 wherein said bottom and top plate are provided with one or more through bores extending across opposed side faces thereof to receive therethrough wiring or piping.

5. A composite wood stud as claimed in claim 2 in combination with a wall top plate, said wall top plate being comprised of a pair of elongated horizontal members of rectangular cross-section defining opposed flat side faces and opposed narrow flat end faces, said pair of members being secured in juxtaposition on said flat side faces, and a transverse elongated horizontal web piece of rectangular cross-section secured along at least one of said opposed narrow end faces of an upper one of said pair of elongated horizontal members and having a longitudinal end edge flush with an outer one of said opposed flat side faces of said upper one of said horizontal members and projecting over an upper portion of said lower horizontal member, said horizontal web piece having substantially the same thickness as said elongated web piece secured to said flat end face of said main member.

6. A composite wood stud as claimed in claim 5 wherein there are two of said horizontal web pieces secured respectively to one of said opposed narrow flat end faces of said upper elongated horizontal member.

7. A composite wood joist as claimed in claim 5 wherein said upper one of said pair of elongated horizontal members is provided with a plurality of equidistantly spaced transverse grooves of rectangular cross-section on an upper one of said opposed side faces thereof to receive in close-fit therein a transversely disposed load support joist or rafter.

8. A composite wood stud as claimed in claim 2 in combination with a wall bottom plate, said wall bottom plate being an elongated wood piece of rectangular cross-section defining opposed flat side faces and opposed narrow flat end faces, there being a plurality of equidistantly spaced transverse grooves of rectangular cross-section formed in an upper one of said flat side faces and dimensioned to receive a lower end portion of said main member in close fit therein.

9. A composite wood joist as claimed in claim 8 wherein said wall top plate is an elongated wood piece of rectangular cross-section defining opposed flat side faces and opposed narrow flat end faces, there being a plurality of equidistantly spaced transverse grooves of rectangular cross-section formed in a lower one of said flat side faces and dimensioned to receive an upper end portion of said main member in close fit therein.

10. A composite wood joist as claimed in claim 1 wherein said main member is further provided with a transverse rectangular groove in each of said opposed flat side faces intermediate opposed ends thereof at a predetermined location whereby to receive an end of a cat member utilized for bracing of opposed studs.

11. A composite wood joist as claimed in claim 1 wherein said main member is further provided with a transverse rectangular groove in at least one of said narrow flat end faces intermediate opposed ends thereof at a predetermined location whereby to receive a horizontal, transversely extending elongated wooden bracing board thereacross.

12. A composite wood joist as claimed in claim 11 wherein there are two of said transverse rectangular grooves disposed in alignment with one another in a respective one of said opposed narrow flat end faces to receive an elongated wooden bracing board piece thereacross on opposed sides thereof.

13. A composite wood joist as claimed in claim 12 wherein said elongated wooden bracing board piece is provided with transverse grooves on an inner face thereof and spaced apart to be received in associated ones of said transverse rectangular grooves in a plurality of main members.

14. A composite wood joist as claimed in claim 1 wherein said main member is further provided with one or more through bores extending across said opposed flat side faces to receive therethrough wiring or piping.

15. A composite wood joist as claimed in claim 1 wherein there is further provided a jamb receiving member securable to one of said opposed flat side faces of said main member, said jamb receiving member having a rectangular cross-section with an elongated rectangular notch formed along an edge portion of one of opposed narrow end faces thereof and adapted to receive one of said wing sections of said web piece in close fit therein.

16. A composite wood joist as claimed in claim 15 wherein said jamb receiving member is provided with an elongated rectangular notch formed along a common edge portion of both said opposed narrow end faces thereof and adapted to receive one of said wing sections of opposed web pieces secured to a respective one of said opposed narrow flat end faces of said main member and in close fit therein.

17. A composite wood joist as claimed in claim 1 wherein said web piece is provided with a central longitudinal groove of shallow rectangular cross-section whereby to receive therein an outer end section of said one of said opposed narrow flat end faces of said main member.

18. A composite wood joist as claimed in claim 1 wherein said web piece has a width equal to the width of said main member, said web piece having opposed flat side faces and a further main member having one of its end faces secured on an opposed one of said opposed flat side faces and aligned with said main member to constitute a load bearing post.

19. A composite wood joist as claimed in claim 18 wherein a further web piece is secured to an opposed one of said end faces of said further main member and aligned with said other web pieces.

20. A composite wood joist as claimed in claim 19 wherein said web pieces are provided with opposed central longitudinal grooves in said opposed flat side faces thereof to receive respective outer end sections and said flat end faces in close fit therein.

21. A composite wood joist as claimed in claim 2 wherein each of said two of said elongated web pieces are each provided with a central longitudinal groove of shallow rectangular cross-section whereby to receive therein an outer end section of a respective one of said opposed narrow flat end faces of said main member.

* * * * *